United States Patent [19]

Chan

[11] 3,983,887

[45] Oct. 5, 1976

[54] CLIP

[76] Inventor: Man Hing Chan, 88, Nathan Road, 11th Floor, Flat B, Kowloon, Hong Kong

[22] Filed: June 23, 1975

[21] Appl. No.: 589,258

[52] U.S. Cl. ..... 132/48 A; 24/259 HC
[51] Int. Cl.[2] ..... A45D 8/24
[58] Field of Search ..... 132/48, 46; 128/321, 128/337, 346; 24/259 HC

[56] References Cited

UNITED STATES PATENTS

| | | | |
|---|---|---|---|
| 3,057,366 | 10/1962 | Fink | 132/48 R |
| 3,515,153 | 1/1968 | Sanada | 132/48 R |
| 3,805,813 | 4/1974 | Laughton | 132/48 R |

*Primary Examiner*—G.E. McNeill
*Attorney, Agent, or Firm*—Robert G. Slick

[57] ABSTRACT

A hair clip or the like is provided of the type having two metal jaws hinged together at a pivot point and having finger extensions beyond the pivot point with a spring tending to keep the jaws closed. The clip of the present invention utilizes a novel pivot joint and spring holder.

3 Claims, 5 Drawing Figures

CLIP

SUMMARY OF THE INVENTION

Hair clips have long been known of the type having two metal jaws which are hinged together with a spring urging the jaws toward each other and with extensions on the far side of the hinge or pivot point so that the clip can be gripped between the fingers and opened.

In the past, it has been common to provide such clips with a pivot pin which extends between lugs formed near the pivot point of the jaws. A coil spring is ordinarily held by the pivot pin to bias the jaws toward each other.

It has been proposed to eliminate the pivot pin by forming hinge eyes on one of the members with upset projections on the opposite member, rotatably engaging the hinge eyes of the opposite member.

The hair clips heretofore used have not been fully satisfactory since the pivot pin involves the expense of an extra part while the upset projections which may be used to replace the pin are relatively difficult to form and must be formed with great precision. Further, the assembly operation when utilizing projections for a pivot becomes complicated.

It has been proposed to eliminate the coil spring by merely using a leaf spring formed of the metal of which the clip is made but such leaf springs do not have the long life and resiliency of a coil spring.

In accordance with the object of the present invention, an improved clip is provided wherein one of the members is merely notched while the opposite member has upstanding lugs with mating notches; the mating notches form the pivot. These parts are formed from flat stock and do not involve any great deal of precision since the parts may be formed with a substantial amount of latitude and still function. Further, the structure of the present invention is easy to assemble since the parts may be merely snapped into place.

Another object of the present invention is to provide a spring clip wherein a coil spring is employed with the center of the coil spring lying some distance from the pivot point and held on a retainer formed of the metal of which one of the members is made which passes into the center of the coil spring. Thus, it is not necessary to fabricate an extra part to retain the spring in place.

The clip of the present invention can be made from two simple stampings and bending operations thereon from flat stock and assembled into a simple spring.

BRIEF DESCRIPTION OF THE DRAWINGS

In the drawings forming part of this application.

DESCRIPTION OF THE PREFERRED EMBODIMENTS

Figure 1:
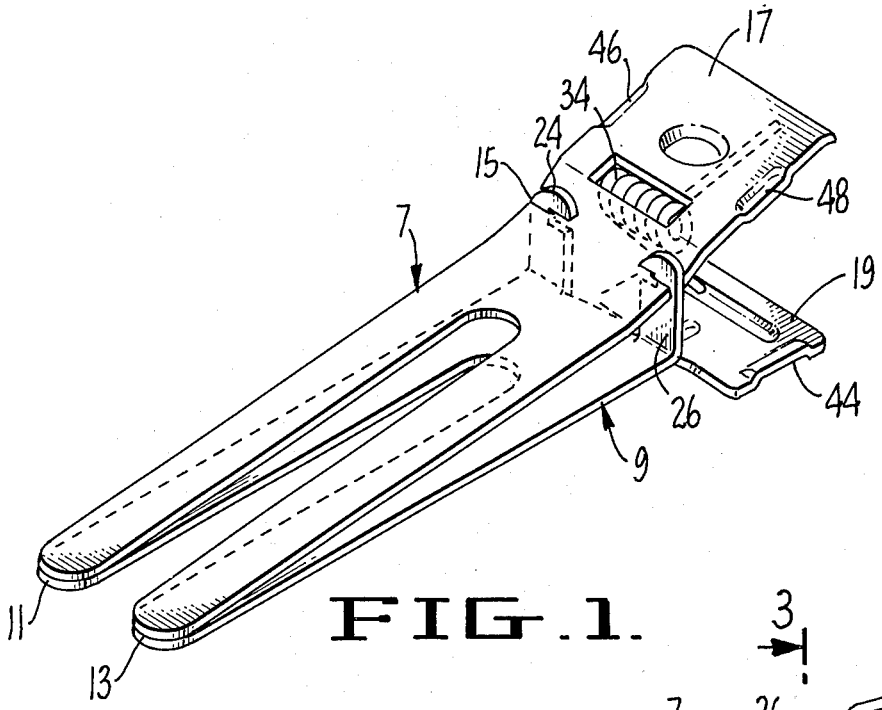
FIG. 1 is a perspective view of a clip embodying the present invention.
Figure 2:
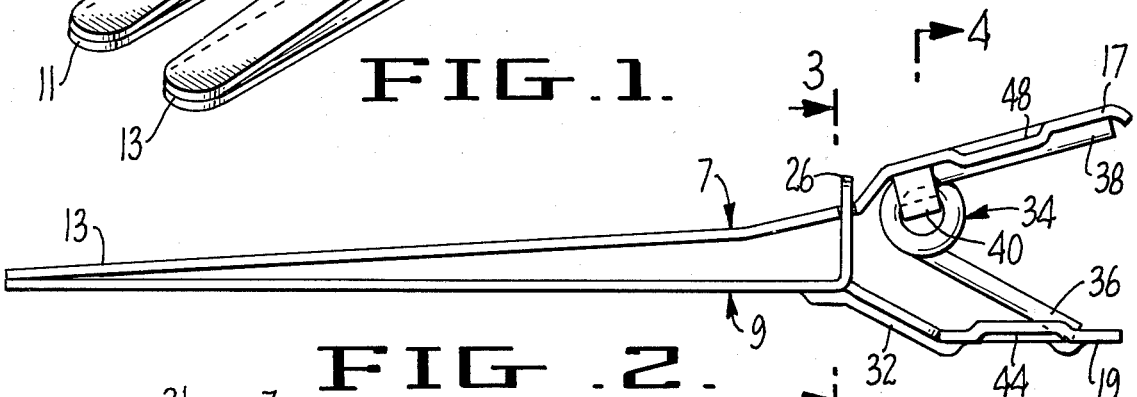
FIG. 2 is a side view of the clip shown in FIG. 1.
Figure 3:
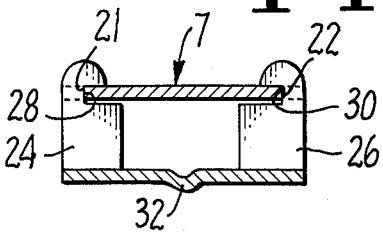
FIG. 3 is a section on the line 3—3 of FIG. 2.
Figure 4:
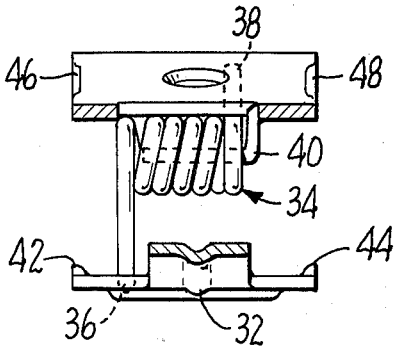
FIG. 4 is a section on the line 4—4 of FIG. 2.
Figure 5:
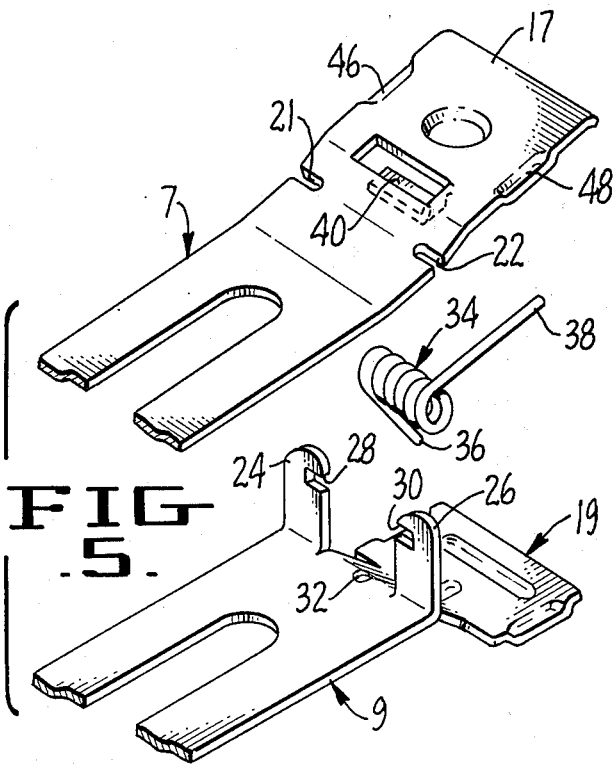
FIG. 5 is an exploded view of the individual parts which constitute the clip.

Referring now to the drawings by reference characters, there is shown a clip having an upper jaw generally designated 7 and a lower jaw generally designated 9. It will be understood that the terms "upper" and "lower" are used merely for convenience and that the clip could be used in any position. In the embodiment shown, the jaws are fabricated to form the fingers 11 and 13 but it will be understood that the jaws may take on different forms depending upon the use to which the clip is to be put. The jaws are pivoted generally on the line designated 15 and finger extensions 17 for the upper jaw and 19 for the lower jaw are formed beyond the pivot point so that the clip can be readily grasped between the thumb and a finger and opened. Although separate numbers have been given to the jaws and to the finger extensions, it will be understood, of course, that the upper jaw and the lower jaw are each formed of a single piece of stamped metal.

Notches 21 and 22 are provided in the upper member while the lower member is provided with upstanding ears 24 and 26 which have the inwardly directed notches respectively 28 and 30. These ears are, of course, stamped out of the metal of the bottom portion. Since this does tend to weaken the bottom portion somewhat, a reinforcing rib 32 is preferably formed in the bottom.

A coil spring generally designated 34 is provided having terminal ends 36 and 38. To retain this spring in place, a retainer 40 is formed in the finger member 17. The retainer 40 is formed by cutting out and deforming a portion of the metal of the finger 17 as shown. A coil spring 34 is assembled over retainer 40 with the terminal end 36 bearing against finger 19 and the opposite terminal end 38 bearing against the finger portion 17. Preferably, the fingers are formed with ledges 42, 44, 46 and 48 so that there is no tendency of the spring to slip off of the finger members nor from the retainer 40.

It will be obvious to those skilled in the art that many departures can be made from the exact structure shown without departing from the spirit of this invention.

I claim:

1. In a hair clip or the like including a first member and a second member, the center portions of said members being hinged together, whereby a pair of jaws is formed at one end of said members and finger gripping means is formed at the opposite end of said members, said clip having a spring biasing said jaws together and being operable by pressure on said finger gripping means of said members, the improvement comprising:

a. a pair of inwardly directed notches lying substantially flat with the surface and located on opposite edges of said first member, b. a pair of upwardly extending lugs formed integrally on said second member, said lugs lying generally at right angles to said second member, said lugs having inwardly directed notches corresponding in location and being adapted to mate with the notches of said first member, the notches of said lugs having projections above and below the notches, and c. the notches of said first member fitting into the notches of said lugs whereby a hinge is formed between the flat surfaces of said first member and the projections of said lugs.

2. The structure of claim 1 wherein said spring is a coil spring pressing against said finger means tending to hold said jaws in a closed position, said coil spring having a central portion, said clip having a spring retainer formed integral with said first member by cutting and bending a portion of the material from which said first member is made, said spring retainer lying parallel to said first member and extending completely through the coil of said spring, holding it in place.

3. The structure of claim 2 wherein inwardly directed projections are formed on each of said finger gripping means, the terminal ends of said spring extend along a side of said projections whereby said ends are prevented from slipping off of said member by said projections.

* * * * *